US006924774B2

(12) United States Patent
Komatsu et al.

(10) Patent No.: US 6,924,774 B2
(45) Date of Patent: Aug. 2, 2005

(54) ON-BOARD ANTENNA

(75) Inventors: Satoru Komatsu, Saitama (JP); Hiroshi Kuribayashi, Saitama (JP); Tomoyuki Fukumaru, Saitama (JP); Hiroshi Iijima, Osaka (JP); Hideaki Oshima, Osaka (JP); Tatsuo Matsushita, Ibaraki (JP)

(73) Assignees: Honda Motor Co., Ltd., Tokyo (JP); Nippon Sheet Glass Company, Ltd., Osaka (JP)

( * ) Notice: Subject to any disclaimer, the term of this patent is extended or adjusted under 35 U.S.C. 154(b) by 32 days.

(21) Appl. No.: 10/744,003

(22) Filed: Dec. 24, 2003

(65) Prior Publication Data

US 2004/0135731 A1 Jul. 15, 2004

(30) Foreign Application Priority Data

Dec. 27, 2002 (JP) ..... P2002-379993

(51) Int. Cl.[7] ..... H01Q 13/10

(52) U.S. Cl. ..... 343/767; 343/711; 343/712; 343/713; 343/789; 343/700 MS

(58) Field of Search ..... 343/711, 712, 343/713, 767, 769, 789, 700 MS

(56) References Cited

U.S. PATENT DOCUMENTS 4,682,180 A * 7/1987 Gans ..... 343/769
5,568,159 A * 10/1996 Pelton et al. ..... 343/767
5,621,419 A * 4/1997 Meek et al. ..... 343/770
5,629,712 A * 5/1997 Adrian et al. ..... 343/713
5,905,471 A * 5/1999 Biebl et al. ..... 343/769
6,097,345 A * 8/2000 Walton ..... 343/769
6,329,950 B1 * 12/2001 Harrell et al. ..... 343/700 MS
6,448,935 B2 * 9/2002 Fuchs et al. ..... 343/713
2001/0050651 A1 * 12/2001 Grangeat et al. ..... 343/767

FOREIGN PATENT DOCUMENTS

JP 2002-252520 9/2002

* cited by examiner

*Primary Examiner*—Shih-Chao Chen
*Assistant Examiner*—Leith Al-Nazer
(74) *Attorney, Agent, or Firm*—Arent Fox PLLC

(57) ABSTRACT

An on-board antenna comprising a radiation element provided on a dielectric substrate, a grounding conductor surrounding a periphery of an outer edge portion of the radiation element at a position spaced away outwardly from the outer edge portion, a substantially box-shaped reflecting member including an opening thereof. The opening of the reflecting member is closed by the surface of the dielectric substrate so as to face the radiation element, and a conductive member is provided at least partially on an inner surface of the reflecting member.

7 Claims, 3 Drawing Sheets

ON-BOARD ANTENNA

BACKGROUND OF THE INVENTION

1. Field of the Invention

The present invention relates to an on-board antenna.

2. Description of the Related Art

Conventionally, a planar antenna is known which comprises a radiation element provided on the same surface of, for example, an automotive window glass which is located on a passenger compartment side thereof and a substantially annular grounding conductor which surrounds the periphery of an outer edge portion of the radiation element at a position spaced away outwardly from the outer edge portion of the radiation element (for example, refer to Japanese Published Patent Application JP-A-2002-252520.

Incidentally, in installing the planer antenna according to the aforesaid conventional example on a vehicle, in the event that the planner antenna is installed on an automotive window glass such as a front windshield or rear window glass, for example, it is desired to prevent the antenna not only from interrupting the vision of occupants but also from deteriorating the external appearance of the vehicle.

However, in the event that the dimensions and layout of the planar antenna are regulated based on the external appearance of the vehicle, for example, there may be caused a risk that attaining desired transmitting and receiving properties is made difficult.

SUMMARY OF THE INVENTION

The present invention was made in view of the situations, and an object thereof is to provide an on-board antenna which can improve the transmitting and receiving properties thereof while suppressing the deterioration in vehicle installation properties thereof.

With a view to solving the problem so as to attain the object, according to a first aspect of the present invention, there is provided an on-board antenna comprising a radiation element (for example, a radiation conductor 21 in an embodiment) provided on the same surface (for example, a passenger compartment-side inner surface 2A in the embodiment) of a dielectric substrate (for example, a rear window glass 2 in the embodiment) and a grounding conductor which surrounds a periphery of an outer edge portion of the radiation element at a position spaced away outwardly from the outer edge portion, wherein an opening formed in a substantially box-like reflecting member is closed by the surface of the dielectric substrate in such a manner that the opening faces the radiation element, and in that a conductive member (for example, a conductive inner surface 32 in the embodiment) is provided at least partially on an inner surface of the reflecting member.

According to the on-board antenna constructed as described above, since the opening formed in the substantially box-like reflecting member is closed by one of surfaces of the dielectric substrate in such a manner that the opening faces the radiation element, a radio wave which propagates from the radiation element toward the reflecting member is reflected by the conductive member provided on the inner surface of the reflecting member so as to propagate toward from the opening toward the radiation element. Due to this, by setting appropriately the dimensions of the reflecting member, for example, the reflecting member is allowed to function as, as it were, a resonator box, so that electromagnetic energy can be amplified a desired resonant frequency, whereby the transmitting and receiving properties of the on-board antenna can be improved relative to a desired direction.

Moreover, since the conductive member is provided on the inner surface of the reflecting member with an outer surface of the reflecting member, for example, being provided with a non-conductive member, in the event that the conductive member of the reflecting member, for example, is brought into contact with the grounding conductor, even if an appropriate conductor or a dielectric substance including a human body is brought into contact with the outer surface of the reflecting member, it is possible to suppress the occurrence of change in electric field between the outer edge portion of the radiation element and the grounding conductor.

In addition, according to a second aspect of the present invention, there is provided an on-board antenna as set forth in the first aspect of the present invention, wherein the opening in the reflecting member surrounds the periphery of the outer edge portion of the radiation element at a position spaced away from the outer edge portion.

According to the on-board antenna constructed as described above, since electric current is induced by the electric field between the outer edge portion of the radiation element and the grounding conductor, so that an electromagnetic wave is emitted from the electric current so induced, the periphery of the outer edge portion of the radiation element can be surrounded by an inner edge portion of the opening in the reflecting member at the position spaced away from the outer edge portion, whereby electromagnetic energy of a radio wave emitted from between the radiation element and the grounding element can be amplified by the reflecting member.

Furthermore, according to a third aspect of the present invention, there is provided an on-board antenna as set forth in the first aspect of the present invention, wherein a conductive member is provided totally on the inner surface of the reflecting member.

According the on-board antenna constructed as described above, the amplifying operation of electromagnetic energy by the reflecting member can be increased.

Moreover, according to a fourth aspect of the present invention, there is provided an on-board antenna as set forth in the first aspect of the present invention, wherein the reflecting member comprises a conductive member.

According to the on-board antenna constructed as described above, the amplifying operation of electromagnetic energy by the reflecting member can be-increased.

According to a fifth aspect of the present invention, there is provided an on-board antenna as set forth in the first aspect of the present invention, wherein a radiation element formed of a semiconductor is provided in place of the radiation conductor.

According to a fifth aspect of the present invention, there is provided an on-board antenna as set forth in the first aspect of the present invention, wherein an open edge of a conductive inner surface of the reflecting member is in abutment with the grounding conductor.

According to a fifth aspect of the present invention, there is provided an on-board antenna as set forth in the first aspect of the present invention, wherein an additional dielectric substance is provided between the open edge of the conductive inner surface of the reflecting member and the dielectric substrate.

DETAILED DESCRIPTION OF THE PREFERRED EMBODIMENTS

Referring to the accompanying drawings, an embodiment of an on-board antenna of the present invention will be described below.

Figure 1:
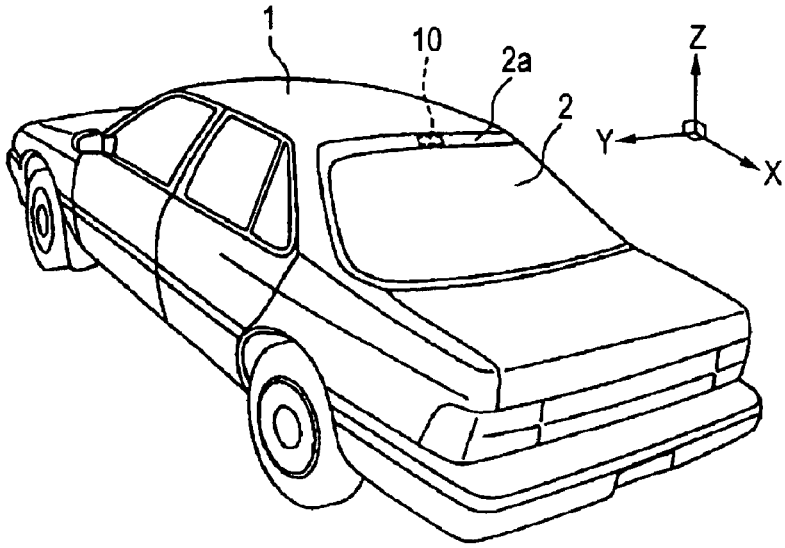
FIG. 1 is a perspective view of a vehicle on which an on-board antenna according to an embodiment of the present invention is installed.
Figure 2:
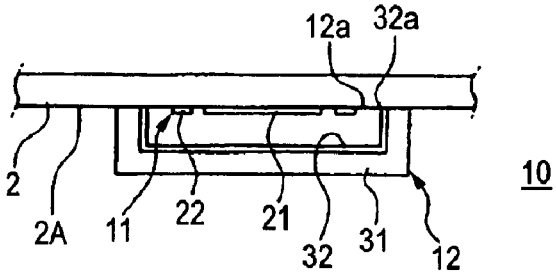
FIG. 2 is a cross-sectional view of the on-board antenna shown in FIG. 1.

An on-board antenna 10 according an embodiment of the present invention is, as shown in FIGS. 1 and 2, disposed on, for example, a passenger compartment-side inner surface 2A of a peripheral edge portion 2*a* of a rear window glass, for example, of window glasses of a vehicle 1.

Then, this on-board antenna 10 is may be, for example, a GPS antenna used in receiving a positioning signal from a GPS (Global Position System) communications network for measuring the position of a vehicle by making use of an artificial earth satellite or transmitting an emergency message by making use of positional information from GPS, for example, a DSRC (Dedicated Short Range Communications) antenna used in receiving data distributed from various types of information providing services or implementing a process of automatic toll collection through a narrow area radio communications DSRC between roadside radio equipment and on-board radio equipment, for example, an antenna for receiving data distributed from broadcasting and/or various types of information providing services which utilize an artificial earth satellite, or, for example, a mobile communications antenna used for mobile communications between an artificial earth satellite or appropriate base station and the vehicle.

The on-board antenna 10 includes, for example, a planar antenna 11 disposed on a passenger compartment-side inner surface 2A of a rear window glass 2 which functions as a dielectric substrate and a substantially box-like reflecting member 12 disposed in such a manner as to cover a surface of the planar antenna 11.

Figure 3:
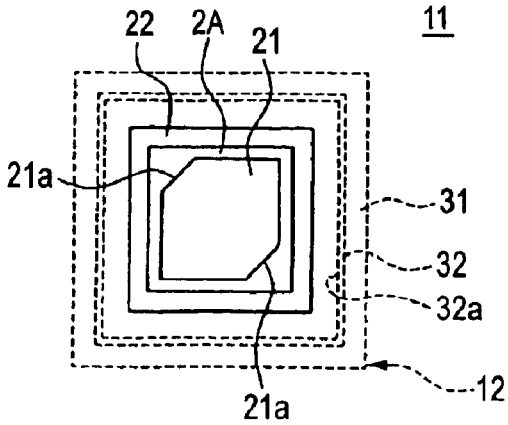
FIG. 3 is a plan view of the on-board antenna shown in FIG. 1.

The planar antenna 11 includes, for example, as shown in FIG. 3, a radiation element 21 comprising a conductive film disposed on the passenger compartment-side inner surface 2A of the rear window glass 2 and a grounding conductor 22.

The radiation element 21 is formed such that, in a substantially quadrangular conductive film having two pairs of two opposing sides, for example, a pair of two corner portions of two pairs of two opposing corner portions which are formed by two adjacent sides which intersect each other substantially at right angles is cut so as to form substantially linear perturbative portions 21*a*, 21*a*, so that a circularly polarized wave mode is generated by these perturbative portions 21*a*, 21*a*.

Then, the radiation element 21 is connected to an appropriate feeding line (not shown) so that an appropriate high-frequency electric current is fed thereto.

The grounding conductor 22 is, for example, formed into a substantially quadrangular annular conductive film and is connected to an appropriate ground wire (not shown) so as to be grounded at all times. The grounding conductor 22 is disposed so as to surround the periphery of an outer edge portion of the radiation element 21 provided on the passenger compartment-side inner surface 2A at a position spaced away outwardly from the outer edge portion.

According to this construction, the passenger compartment-side inner surface 2A of the rear window glass 2 which is made to function as the dielectric substrate is exposed between the outer edge portion of the radiation element 21 and an inner edge portion of the grounding conductor 22, and the planar antenna 11 is made to function as an antenna when a so-called resonance circuit is formed between the radiation element 21 and the grounding conductor 22.

Here, by setting the antenna properties of the planar antenna, for example, the resonant frequency and frequency band of a radio wave to be transmitted and received to desired values, the permittivity of the rear window glass 2 made to function as the dielectric substrate, respective lengths of the two pairs of opposing sides of the radiation element 21 and the distance between the outer edge portion of the radiation element 21 and the inner edge portion of the grounding conductor 22 are set to appropriate values.

The reflecting member 12 includes, for example, a reflecting member main body 31 comprising a substantially box-like non-conductive member having an opening 12*a* and a conductive inner surface 32 comprising a conductive member provided so as to cover completely over an inner surface of the reflecting member main body 31.

Then, an inner portion of the opening 12*a* that is an opening edge 32*a* of the conductive inner surface 32 surrounds the periphery of an outer edge portion of the grounding conductor 22 at a position spaced away outwardly from the outer edge portion of the grounding conductor 22 provided on the passenger compartment-side inner surface 2A so as that the opening 12*a* of the reflecting member 12 faces the planar antenna 11.

Note that the size of the reflecting member 12 and dimensions of respective portions thereof are set to appropriate values which generate a resonance according to the resonant frequency of a radio wave to be transmitted and received.

The on-board antenna 10 according to the embodiment of the present invention is constructed as has been described heretofore, and the operation properties of the on-board antenna 10 will be described below by reference to the accompanying drawings.

In this on-board antenna 10, in receiving a radio wave which propagates in such a manner as to pass through the rear window glass 2 from the outside of the vehicle, for example, since a radio wave which propagates from the radiation element 21 toward the interior of the reflecting member 12 is reflected by the conductive inner surface 32 of the reflecting member 12 and is then returned from the opening 12*a* in the reflecting member 12 to the radiation element 21, the reflecting member can be made to function, as it were, a resonator box, thereby making it possible to amplify electromagnetic energy at a desired resonant frequency.

Figure 4A:
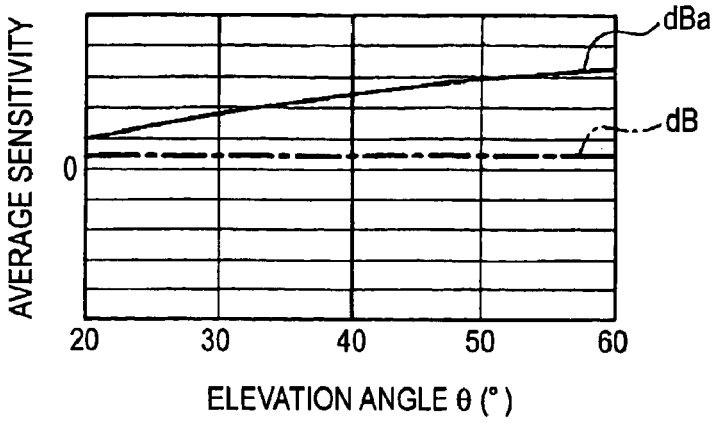
FIG. 4A is a graph illustrating one example of a change according to a elevation angle θ in average sensitivity of the on-board antenna shown in FIG. 1.

According to this construction, for example, as shown in FIG. 4A, a change according to an elevation angle θ in average value (average sensitivity) dBa around a vertical axis (an axis Z shown in FIG. 1) of a sensitivity that is a gain relative to a radio wave at a desired resonant frequency of the on-board antenna 10 becomes a larger value than a predetermined lower limit average sensitivity dB, and hence it is recognized that a desired transmitting and receiving sensitivity can be secured.

Figure 4B:
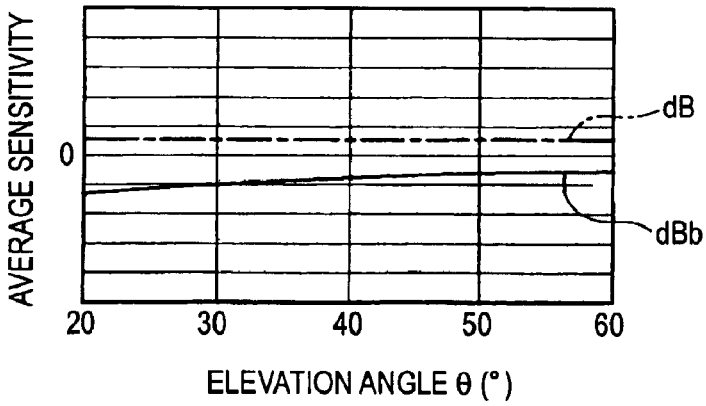
FIG. 4B is a graph illustrating one example of a change according to a elevation angle θ in average sensitivity which results when a reflecting member is omitted from the on-board antenna shown in FIG. 1.

In addition, here, as shown in FIG. 4B, for example, an average sensitivity dBb resulting when the reflecting member 12 is omitted becomes a smaller value than the predetermined lower limit average sensitivity dB, and hence it is recognized that the desired transmitting and receiving sensitivity cannot be secured.

Figure 5A:
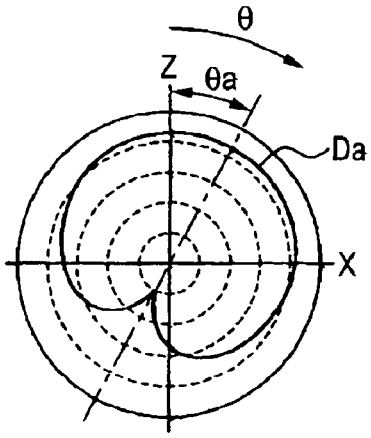
FIG. 5A is a graph illustrating one example of a change according to an elevation angle θ in sensitivity within a plane containing a vertical axis Z and a longitudinal axis X of a vehicle which is associated with the on-board antenna shown in FIG. 1.
Figure 5B:
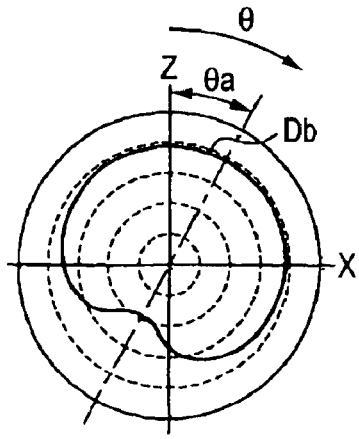
FIG. 5B is a graph illustrating one example of a change according to an elevation angle θ in sensitivity within the plane containing the vertical axis Z and the longitudinal axis X of the vehicle which results when the reflecting member is omitted from the on-board antenna shown in FIG. 1.

In addition, as shown in FIG. 5A, in a change according to the elevation angle θ in sensitivity Da relative to a radio wave at a desired resonant frequency of the on-board antenna 10 within a plane containing the vertical axis Z (the axis Z shown in FIG. 1) and a longitudinal axis X (an axis X shown in FIG. 1) of the vehicle in a state in which the on-board antenna 10 is actually installed on the vehicle, it is recognized that the directional characteristics are improved when compared with sensitivities Db resulting when the reflecting member 12 is omitted as shown in FIG. 5B, for example.

Note that in FIGS. 5A, 5B, in the state in which the on-board antenna 10 is actually installed on the vehicle, the normal line of the planar antenna 11 intersects the vertical axis-Z by an angle θa.

Figure 6:
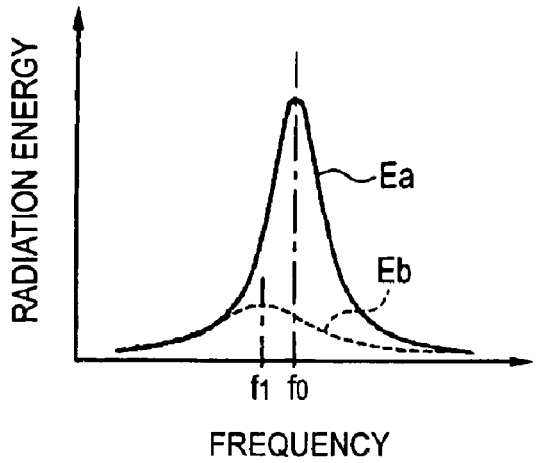
FIG. 6 is a graph illustrating examples of changes according to frequency in radiated energy which is associated with the on-board antenna shown in FIG. 1 and which result when the reflecting member is omitted from the on-board antenna shown in FIG. 1.

In addition, as shown in FIG. 6, a change according to the frequency in radiation energy Ea of the on-board antenna 10 becomes a larger value than radiation energy Eb resulting when the reflecting member 12 is omitted, and hence it is recognized that the electromagnetic energy can be amplified by the reflecting member 12.

In addition, in FIG. 6, with respect to the frequency at which radiation energy becomes a maximum value, it is recognized that the frequency f0 of radiation energy Ea of the on-board antenna 10 becomes a higher value than the frequency f1 of radiation energy resulting when the reflecting member 12 is omitted.

As has been described heretofore, according to the on-board antenna 10 according to the embodiment of the present invention, by providing the substantially box-like reflecting member 12 having the conductive inner surface 32, the reflecting member 12 can be made to function as, as it were, the resonator box, thereby making it possible to amplify electromagnetic energy at a desired resonant frequency, whereby the transmitting and receiving properties of the on-board antenna 10, in particular, the gain and directional characteristics-can be improved.

Note that while, in the embodiment of the present invention, the inner surface of the reflecting member main body 31 comprising the non-conductive member is completely covered with the conductive member, the present invention is not limited thereto, and the conductive member maybe provided, for example, partially on the inner surface of the reflecting member main body 31.

In addition, the reflecting member 12 may be formed of a conductive member. In such a case, however, the reflecting member 12 is preferably disposed in such a manner as not to be brought into contact with the radiation element 21 and the grounding conductor 22 of the planar antenna 11.

Additionally, while, in the embodiment of the present invention, the planar antenna 11 is exposed on the passenger compartment side with the open edge 32*a* of the conductive inner surface 32 of the reflecting member being in abutment with the passenger compartment-side inner surface 2A, the present invention is not limited thereto. In a case where the both sides of the planer antenna 11 are constructed to be held between mating surfaces of a laminated glass comprising a plurality of sheets of glass, a dielectric substance such as another-glass may be provided between the open edge 32*a* of the conductive inner surface 32 of the reflecting member 12 and the glass made to function as the dielectric substrate of the planar antenna 11.

Figure 7:
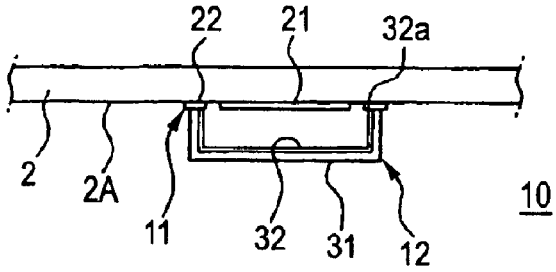
FIG. 7 is a cross-sectional view of an on-board antenna according to a modified example to the embodiment of the present invention.
Figure 8:
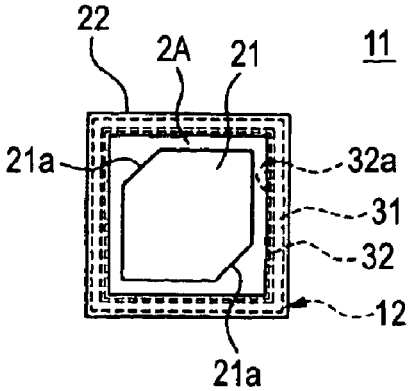
FIG. 8 is a plan view of the on-board antenna according to the modified example to the embodiment of the present invention.

Furthermore, while, in the embodiment of the present invention, the open edge 32*a* of the conductive inner surface 32 of the reflecting member 12 is disposed in such a manner as to surround the periphery of the outer edge portion of the grounding conductor 22 at the position spaced away outwardly from the outer edge portion of the grounding conductor 22, the present invention is not limited thereto. For example, as with an on-board antenna 10 according to a modified example to the aforesaid embodiment which is shown in FIGS. 7 and 8, an open edge 32*a* of a conductive inner surface 32 of a reflecting member 12 may be in abutment with a grounding conductor 22.

In addition, in an area where a compartment-side inner surface 2A of a rear window glass 2 which is made to function as a dielectric substrate is exposed between an outer edge portion of a radiation element 21 and a inner edge portion of the grounding conductor 22, the open edge 32*a* of the conductive inner surface 32 of the reflecting member 12 may be disposed in such a manner as to surround an outer edge portion of the radiation element 21 at a position spaced away outwardly from the outer edge portion.

Note that while, in the embodiment of the present invention, the planar antenna 11 is made to include the radiation conductor 21 which is formed of the conductive film and the grounding conductor, the present invention is not limited thereto. For example, a radiation element formed of a semiconductor may be provided in place of the radiation conductor 21.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

As has been described heretofore, according to the on-board antenna as set forth in the first aspect of the present invention, by making the reflecting member to function as, as it were, the resonator box so as to amplify the electromagnetic energy at the desired resonant frequency, the transmitting and receiving properties of the on-board antenna can be improved.

In addition, according to the on-board antenna as set forth in the second aspect of the present invention, the electromagnetic energy of the radio wave emitted from between the radiation element and the grounding conductor can be amplified by the reflecting member.

Furthermore, according to the on-board antenna as set forth in the third and fourth aspects of the present invention, the amplifying operation of the electromagnetic energy by the reflecting member can be increased.

What is claimed is:

1. An on-board antenna comprising:

a radiation element provided on a dielectric substrate;

a grounding conductor surrounding a periphery of an outer edge portion of the radiation element at a position spaced away outwardly from the outer edge portion; and a substantially box-shaped reflecting member including an opening thereof;

wherein the opening of the reflecting member is closed by the surface of the dielectric substrate so as to face the radiation element, and a conductive member is provided at least partially on an inner surface of the reflecting member.

2. An on-board antenna as set forth in claim 1, wherein the opening of the reflecting member surrounds the periphery of the outer edge portion of the radiation element at a position spaced away from the outer edge portion, when the reflecting member is put on the dielectric substrate.

3. An on-board antenna as set forth in claim 1, wherein the conductive member is provided totally on the inner surface of the reflecting member.

4. An on-board antenna as set forth in claim 1, wherein the reflecting member is formed of the conductive member.

5. An on-board antenna as set forth in claim 1, wherein the radiation element is a semiconductor.

6. An on-board antenna as set forth in claim 1, wherein the reflecting member is surrounds the periphery of the outer edge portion of the grounding conductor, when the reflecting member is put on the dielectric substrate.

7. An on-board antenna comprising:

a radiation element provided on a first dielectric substrate;

a grounding conductor surrounding a periphery of an outer edge portion of the radiation element at a position spaced away outwardly from the outer edge portion;

a second dielectric substrate provided on the radiation element and the grounding conductor; and a substantially box-shaped reflecting member including an opening thereof;

wherein the opening of the reflecting member is closed by the surface of the second dielectric substrate so as to face the radiation element, and a conductive member is provided at least partially on an inner surface of the reflecting member.

* * * * *